US008943659B2

(12) United States Patent
Bayer et al.

(10) Patent No.: US 8,943,659 B2
(45) Date of Patent: Feb. 3, 2015

(54) METHOD AND DEVICE FOR THE SURFACE PEENING OF A PARTIAL ELEMENT OF A COMPONENT OF A GAS TURBINE

(75) Inventors: Erwin Bayer, Dachau (DE); Max Niegl, Munich (DE); Holger Polanetzki, Dachau (DE); Thomas Peschke, Groebenzell (DE); Thomas Dautl, Weichs (DE); Philipp Thuemmler, Munich (DE)

(73) Assignee: MTU Aero Engines GmbH, Munich (DE)

( * ) Notice: Subject to any disclaimer, the term of this patent is extended or adjusted under 35 U.S.C. 154(b) by 1421 days.

(21) Appl. No.: 12/519,127

(22) PCT Filed: Dec. 5, 2007

(86) PCT No.: PCT/DE2007/002196

§ 371 (c)(1),
(2), (4) Date: Jan. 25, 2010

(87) PCT Pub. No.: WO2008/071162

PCT Pub. Date: Jun. 19, 2008

(65) Prior Publication Data

US 2010/0125990 A1 May 27, 2010

(30) Foreign Application Priority Data

Dec. 13, 2006 (DE) ..... 10 2006 058 678

(51) Int. Cl.

| | |
|---|---|
| ***B21C 37/30*** | (2006.01) |
| ***B24C 1/10*** | (2006.01) |
| ***B24C 5/00*** | (2006.01) |
| ***F01D 5/28*** | (2006.01) |

(52) U.S. Cl.

CPC . *B24C 1/10* (2013.01); *B24C 5/005* (2013.01); *F01D 5/286* (2013.01); *F05D 2230/41* (2013.01)

USPC ..... 29/90.7; 29/889.2; 29/889.23

(58) Field of Classification Search

CPC ..... B24C 1/10; B23P 15/006; F01D 25/285; B23C 3/18

USPC ..... 29/90.7, 889.2, 889.23

See application file for complete search history.

(56) References Cited

U.S. PATENT DOCUMENTS

| | | | | |
|---|---|---|---|---|
| 7,028,378 | B2 * | 4/2006 | Cheppe et al. | 29/90.7 |
| 2006/0174483 | A1 * | 8/2006 | Bayer et al. | 29/889.2 |

FOREIGN PATENT DOCUMENTS

| | | |
|---|---|---|
| EP | 1 101 568 B1 | 5/2001 |
| EP | 1 623 794 A1 | 2/2006 |
| FR | 2 689 431 | 10/1993 |
| WO | WO 02/24411 A1 | 3/2002 |

* cited by examiner

*Primary Examiner* — Ryan J Walters
(74) *Attorney, Agent, or Firm* — Crowell & Moring LLP

(57) ABSTRACT

A method and device for the surface peening, especially ultrasonic shot-peening, of at least one partial element of a component of a gas turbine, is disclosed. The partial element, e.g., a sealing fin, and at least one surface of a vibration device impinging the blasting material are positioned relative to each other at an angle between 70° and 90° based on the direction of extension of the sealing fin.

11 Claims, 1 Drawing Sheet

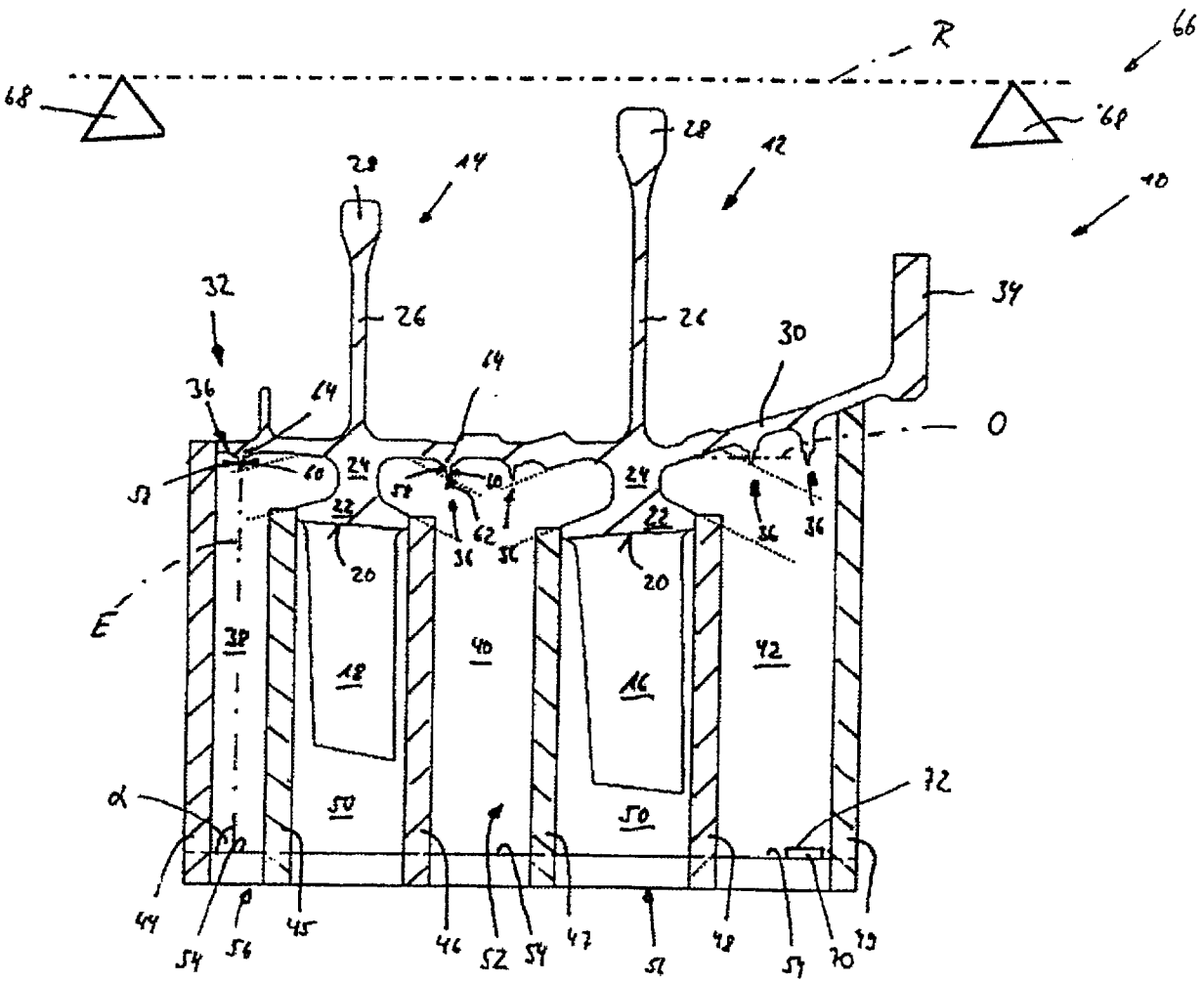

METHOD AND DEVICE FOR THE SURFACE PEENING OF A PARTIAL ELEMENT OF A COMPONENT OF A GAS TURBINE

This application claims the priority of International Application No. PCT/DE2007/002196, filed Dec. 5, 2007, and German Patent Document No. 10 2006 058 678.6, filed Dec. 13, 2006, the disclosures of which are expressly incorporated by reference herein.

The invention relates to a method and a device for the surface peening, in particular ultrasonic shot-peening, of at least one partial element of a component, in particular a blisk of a gas turbine.

This type of method and such a device are already known for example from European Patent Document No. EP 1 101 568 B1, wherein the rotor blades of a rotor embodied as a blisk are shot-peened to improve their fatigue strength. To do this, the rotor is positioned in a holding device such that it is held so that it can be rotated around its axis of rotation. By rotating the rotor, its rotor blades are guided through a peening chamber, which has a vibration device arranged on its underside in the form of an ultrasonic sonotrode having one vibrating surface running at least approximately horizontally. The peening chamber in this case is bordered both axially, i.e., in the area of the broadside of the rotor, and radially, i.e., in the area of the rotor blades, of the blisk by corresponding chamber walls.

One problem with these types of known methods for surface peening rotors is that, particularly in the case of thin-walled partial elements, there is a danger of deformation or warping from the surface peening. For this reason, today it is common to protect these types of partial elements particularly by means of a covering. Since these kinds of thin-walled partial elements of a blisk are frequently for example located in a joint area with an adjacent blisk, this covering can lead to insufficient strengthening of the joint area. In addition, a further problem is that the partial element itself sometimes cannot be strengthened.

As a result, the objective of the present invention is creating a method and a device of the type cited at the outset, which can be used to process partial elements of the component of the gas turbine that could not be processed until now, without the danger of deformations or warping from surface peening.

The inventive method provides that the surface of the at least one vibration device and a thin-walled sealing fin be positioned relative to each another at an angle between 70° and 90° based on the direction of extension of the sealing fin. In other words, the invention provides for the thin-walled sealing fin that previously could not be processed during surface peening of a rotor, in particular of a blisk, without deformations or warping, to be processed in such a way that the surface of at least one vibration device is arranged in the indicated angle range with respect to the sealing fin. This corresponding arrangement of the surface of the vibration device relative to the sealing fin makes it possible for its broadsides to be processed synchronously with blasting material during the peening process. Because both sides of the sealing fin are thereby acted upon uniformly by the blasting material, deformation or even bending away of the partial elements, which are normally a few millimeters thick and high, from the effect of the hail of shots is avoided. On the contrary, the front side and tip of the respective sealing fin, which comes into contact with the intake or rub coating when the engine is in operation, is strengthened in an optimum way. As a result, the abrasion hardness and service life of the front side or tip of the sealing fin increases considerably.

Another advantage is that the joining zones of the rotor or blisk that are frequently arranged in the region of the thin-walled sealing fins can be effectively strengthened so that the tensile internal stress in the heat impact zone of the joint can be converted to compressive stress close to the surface. In the case of a somewhat diagonal arrangement of the surface of the at least one vibration device based on the direction of extension of the sealing fin, it is possible to strengthen its web neck, i.e., the transition area between the sealing fin and an external circumferential wall of the rotor bearing the sealing fin.

In an especially advantageous embodiment, the surface of the at least one vibration device and the sealing fin are positioned relative to each other at an angle between 85° and 90°, and in particular at least approximately perpendicular, based on the direction of extension of the sealing fin. In other words, the surface of the at least one vibration device is preferably positioned at least approximately perpendicular relative to the sealing fin being processed so that an especially uniform and synchronous peening of the two broadsides of the sealing fin is produced and a deformation or bending away of the sealing fin is made impossible.

An especially uniform and reproducible strengthening of the respective sealing fin can be achieved if the sealing fin is processed in a peening chamber comprising the assigned vibration device. Because of the peening chamber, a constant quantity of blasting material and therefore consistent and uniform peening results can be achieved in this process in a simple way.

An especially synchronous and uniform peening of the two broadsides can be advantageously realized if the boundary walls of the peening chamber are arranged essentially parallel to the direction of extension of the sealing fin.

In another embodiment of the invention, a plurality of sealing fins is processed in a common peening chamber. This results in a process that is optimized in terms of processing time.

The advantages described in relation to the inventive method are also applicable in an identical way for the device according to the invention.

In this case, it has been shown to be particularly advantageous in terms of the device if a peening chamber is equipped with boundary walls, which as dividing walls divide two adjacent peening chambers from one another. As a result, the dividing walls can fulfill a dual function as the respective boundary wall, wherein the two adjacent peening chambers can be arranged at a close distance to one another.

It has also been shown to be advantageous if the peening chamber is provided with chamber walls that are embodied flexibly at least in sections. This makes it possible for the inventive device to be used even in the case of various components having differing geometry.

Finally, it has been shown to be advantageous if a distributing device is provided preferably within the peening chamber, with which the blasting material can be distributed over the surface of the at least one vibration device. The distributing device is preferably arranged correspondingly at the lowest point of the surfaces of the vibration devices so that blasting material gathering there is uniformly distributed, or also positioned in upper regions of the surfaces. As a whole, this results in a consistent quantity of blasting material being available over the entire surfaces so that an extremely uniform strengthening of the sealing fin can be realized.

Additional advantages, features, and details of the invention are disclosed in the following specification of a preferred exemplary embodiment as well as on the basis of the drawing.

BRIEF DESCRIPTION OF THE DRAWING

The drawing shows in a schematic sectional view a rotor of a gas turbine in the form of a blisk where respectively assigned peening chambers with respectively associated vibration devices are provided.

DETAILED DESCRIPTION OF THE DRAWING

The drawing shows in a schematic sectional view a rotor of a gas turbine in the form of a blisk, which in this case comprises two stages and, in the region of a circumferential wall, a plurality of thin-walled sealing fins surrounding the outer circumferential side, where respectively assigned peening chambers with respectively associated vibration devices are provided, whose respective surfaces are arranged at an angle of essentially 90° relative to the assigned sealing fin based on its direction of extension.

In the schematic and axial sectional view at hand depicting a rotatable rotor of a gas turbine in the form of a blisk 10, it is possible to see two stages, which are respectively assigned a first and a second disk 12, 14 as well as a ring from the first and second rotor blades 16, 18. What can be seen of each of the disks 12, 14 is essentially a platform 20 depicted linearly on the outer circumferential side, which is connected radially inwardly to a lower platform region 22. Each of the two lower platform regions 22 merges radially in the inward direction into a respective disk neck 24, which connects the associated lower platform region 22 with a disk body 26. The radial inner end of the respective disk body 26 is formed by an associated hub 28, which represents a counterweight to the respective rotor blades 16, 18. The two disks 12, 14 are connected via a circumferential wall 30, which is embodied rotationally symmetrically around an axis of rotation R of the blisk 10 and extends on one side towards a wing 32 and on the other side towards a flange 34.

On the outer circumferential side of the circumferential wall 30, the blisk 10 at hand comprises five thin-walled sealing fins 36 embodied as partial elements, which project radially circumferentially outwardly from the circumferential wall 30 approximately perpendicular with respect to the axis of rotation R of the blisk 10. These thin-walled sealing fins 36 are also generally called "fin sealing lips" or "sealing web" and feature a radial height of 3 mm and a thickness of 2 mm for example. The sealing fins 36 are used to cooperate with an intake or rub coating (not shown), which on the inner circumferential side is surrounded annularly by guide vanes (also not shown) attached to the turbine around the respective associated sealing fin 36.

In order to strengthen the sealing fins 36 through surface peening by means of a blasting material in particular in the form of shots, a total of three peening chambers 38, 40, 42 are provided here, which are bordered by or divided from one another by respective boundary or dividing walls 44, 45, 46, 47, 48, 49. Along with the three peening chambers 38, 40, 42 assigned to the respective sealing fins 36, two additional peening chambers 50 are provided, within which the rotor blades 16, 18 can be strengthened by means of surface peening. Along with the boundary or dividing walls 44, 45, 46, 47, 48, 49, front walls 52 are also assigned to the peening chambers 38, 40, 42, and these front walls may feature corresponding recesses as the case may be in the region of the sealing fins 36.

The FIGURE shows that the four center boundary or dividing walls 45, 46, 47, 48 are each sealed against the assigned platform 20 of the rotor blades 16, 18. This can prevent a loss or transfer of blasting material from the one into the other peening chamber 38, 40, 42, or 50. Corresponding sealing means can be arranged in this case between the respective boundary or dividing wall 45, 46, 47, 48 and the assigned platform 20. Alternatively or additionally, the gap or the distance between the respective boundary or dividing wall 45, 46, 47, 48 and the assigned platform 20 is selected in such a way that the blasting material cannot get through in-between. The outer boundary or dividing walls 44 or 49 are arranged in a sealed manner in an appropriate way with respect to the circumferential wall 30. In addition, the boundary or dividing walls 44, 45, 46, 47, 48, 49 may also be embodied flexibly in order to make it possible to adapt to components or rotors with different geometry.

On the side of the assigned peening chamber 38, 40, 42 opposite from the sealing fins 36, a respective surface 54 of an assigned vibration device 56 is provided, which is embodied here as an ultrasonic sonotrode (not shown) and is assigned to the respective peening chamber 38, 40, 42 as a front-side boundary wall. The respective ultrasonic sonotrode is used to set the respective surface 54 of the vibration device 56 into vibration, whereby the blasting material, which is embodied here as shot, is accelerated for shot-peening. In the present exemplary embodiment, one and same vibration device 56 is used for all the peening chambers 38, 40, 42, i.e., also for the peening chambers 50 of the rotor blades 16, 18, wherein the vibrating surfaces or the surfaces 54 impinging the blasting material assigned to the respective peening chamber 38, 40, 42, or 50 are correspondingly divided by the boundary or dividing walls 44, 45, 46, 47, 48, 49. However, each of the peening chambers 38, 40, 42 may also feature a separate vibration device 56, which is also covered by the scope of the invention.

Each of the sealing fins 36 includes two broadsides (58, 60) (annular in a top view) as well as a rounded narrow front side 62. In addition, it is also evident that each sealing fin 36 includes a web neck 64, through which the circumferential wall 30 merges into the sealing fin 36. As the case may be, the sealing fin 36 can taper towards the outer circumferential side, as can be seen in particular in the FIGURE, wherein the respective individual partial surfaces of each of the two broadsides 58, 60 essentially extend plane-parallel to each other. In this case, the dashed and dotted line E (peening chamber 38) depicts a radial direction of extension on one of the sealing fins 36. This direction of extension E is essentially identical in the case of all sealing fins 36 at hand.

So that the sealing fins 36 are not deformed or bent or otherwise warped during shot-peening, the surfaces 54 of the vibration device 56 assigned to the respective sealing fin 36 are positioned relative to each other at an angle $\alpha$ between 70° and 90° based on the radial direction of extension E of the corresponding sealing fin 36. In the present exemplary embodiment this angle $\alpha$ is at least approximately 90°, because this allows an especially uniform peening of both broadsides 58, 60 of the respective sealing fin 36 to be realized. This especially advantageous strengthening of the two broadsides 58, 60 that can be achieved by this also materializes if the angle $\alpha$ is between 85° and 90°. Hence in the present exemplary embodiment, each of the surfaces 54 of the assigned vibration device 56 and a respective surface normal O (peening chamber 42) of the respective corresponding broadside 58, 60 of the corresponding sealing fin 36 essentially run at least parallel relative to one another. As a result, the two opposing broadsides 58, 60 of the sealing fin 36 are synchronously surface peened by means of the surface 54 of the vibration device 56. The boundary or dividing walls 44, 45, 46, 47, 48, 49 of the peening chambers 38, 40, 42 in the case at hand run essentially parallel to the direction of extension E of the respective sealing web 36 or parallel to its respective broadsides 58, 60. If, as described above, the surface 54 is not arranged at least approximately perpendicular to the radial direction of extension of the sealing fin 36, but the angle α is between 70° and 90°, then each of the boundary or dividing walls 44, 45, 46, 47, 48, 49 runs relative to the respective surface normals O naturally also in a correlating angle.

The relative arrangement of the sealing fins 36 with respect to the corresponding surfaces 54 of the assigned vibration device 56 can be accomplished either by the respective peening chamber 38, 40, 42 being correspondingly positioned with respect to the blisk 10, or vice versa by the blisk 10 being correspondingly arranged with respect to the respective peening chamber 38, 40, 42. In the latter case, as shown here, a holding device 66 can be provided, which is used to arrange the blisk 10 with respect to the peening chamber 38, 40, 42. In doing so, the holding device 66 comprises for example bearing blocks 68, which are only indicated schematically in the FIGURE, through which the blisk 10 is mounted so that it can rotate around its axis of rotation R. As a result, each of the sealing fins 36 can be circumferentially strengthened or peened in one procedural step. However, the relative positioning of the sealing fins 36 and the surfaces 54 can also be accomplished by the chamber walls 44, 45, 46, 47, 48, 49 of the respective peening chamber 38, 40, 42 being used as limit stops with respect to the circumferential wall 30 of the blisk 10.

So that the blasting material does not gather excessively at one deepest point of the assigned peening chamber 38, 40, 42, but is in fact distributed uniformly over the respective surfaces 54, a distributing device 70 is provided, e.g., in the lower region of the peening chamber 42, and the distributing device also comprises a vibrating surface 72. The distributing device 70 in this case can also be embodied as an ultrasonic sonotrode. Other designs would also be likewise conceivable in this case such as a compressed air device, which is able to realize a homogeneous distribution of the blasting material over the respective surfaces 54.

The fact that the device described here and/or the assigned method can be used not just in the case of a blisk 10, but naturally also in the case of other components of gas turbines must be considered included in the scope of the invention.

The invention claimed is:

1. A method for surface peening of a partial element of a component of a gas turbine, comprising positioning the partial element relative to a surface of a vibration device, wherein the vibration device impinges blasting material, wherein the surface of the vibration device and the partial element are positioned relative to each other at an angle between 70° and 90° based on a direction of extension of the partial element, and wherein the partial element is a sealing fin;

wherein the sealing fin is surface peened in a first peening chamber that includes the vibration device, wherein boundary walls of the first peening chamber are arranged substantially parallel to the direction of extension of the sealing fin; and wherein a rotor blade of the component is arranged in a second peening chamber that is adjacent to the first peening chamber, wherein one of the boundary walls of the first peening chamber is a side boundary wall of the second peening chamber.

2. The method according to claim 1, wherein the surface of the vibration device and the sealing fin are positioned relative to each other at an angle between 85° and 90°.

3. The method according to claim 1, wherein the surface of the vibration device and the sealing fin are positioned approximately perpendicular to each other.

4. The method according to claim 1, wherein two opposing broadsides of the sealing fin are synchronously surface peened by the blasting material.

5. The method according to claim 1, wherein a plurality of sealing fins are surface peened in the first peening chamber.

6. The method according to claim 1, wherein during a surface peening of the sealing fin, the component is rotated around an axis of rotation of the component.

7. The method according to claim 1, wherein the component is arranged relative to the surface of the vibration device by a holding device.

8. The method according to claim 1, wherein the surface of the vibration device is a front boundary wall of the first peening chamber and wherein the boundary walls are opposing non-vibrating walls of the first peening chamber.

9. The method according to claim 8, wherein two opposing broadsides of the sealing fin are synchronously surface peened by the blasting material.

10. A method for surface peening of a sealing fin of a rotor of a gas turbine, comprising:

positioning the sealing fin in a first peening chamber, wherein a surface of a vibration device is a front boundary wall of the first peening chamber, wherein opposing non-vibrating walls are side boundary walls of the first peening chamber, and wherein the surface of the vibration device and the sealing fin are positioned relative to each other at an angle between 70° and 90° based on a direction of extension of the sealing fin;

wherein the opposing non-vibrating side boundary walls of the first peening chamber are arranged substantially parallel to the direction of extension of the sealing fin;

surface peening the sealing fin by a blasting material vibrated by the vibration device;

positioning a rotor blade in a second peening chamber that is adjacent to the first peening chamber, wherein one of the opposing non-vibrating walls of the first peening chamber is a side boundary wall of the second peening chamber; and surface peening the rotor blade by a blasting material.

11. The method according to claim 10, wherein two opposing broadsides of the sealing fin are synchronously surface peened.

* * * * *